US005791353A

United States Patent [19]

Jünemann et al.

[11] Patent Number: 5,791,353

[45] Date of Patent: Aug. 11, 1998

[54] METHOD AND APPARATUS FOR DENITRATING TOBACCO STEM MATERIAL

[75] Inventors: Gitta Jünemann, Hamburg; Gerald Schmekel, Elmshorn; Arno Weiss, Norderstedt; Wilfried Stiller, Holm, all of Germany

[73] Assignee: Brown & Williamson Tobaccco Corporation, Louisville, Ky.

[21] Appl. No.: 713,215

[22] Filed: Sep. 12, 1996

[30] Foreign Application Priority Data

Sep. 25, 1995 [DE] Germany ..... 195 35 587.3

[51] Int. Cl.[6] ..... A24B 15/24

[52] U.S. Cl. ..... 131/297; 131/298

[58] Field of Search ..... 131/140, 136, 131/143, 297, 298, 290

[56] References Cited

U.S. PATENT DOCUMENTS 3,575,178 4/1971 Stewart ..... 131/140

5,230,354 7/1993 Smith et al. ..... 131/297

5,360,022 11/1994 Newton et al. ..... 131/297

*Primary Examiner*—Vincent Millin

*Assistant Examiner*—Charles W. Anderson

*Attorney, Agent, or Firm*—Renner, Otto, Boisselle & Sklar, P.L.L.

[57] ABSTRACT

The invention relates to a method of denitrating tobacco stem material in which the tobacco stem material is input at a first point in a housing, guided through a solvent and output at a second point from the housing, the complete method being implemented at an overpressure, and to an apparatus for implementing the method with an elongated, approximately cylindrical housing and at least one rotatable feeder screw, said housing being configured pressure-tight and comprising locks or nozzles or inputting and/or outputting process flows.

15 Claims, 2 Drawing Sheets

METHOD AND APPARATUS FOR DENITRATING TOBACCO STEM MATERIAL

BACKGROUND OF THE INVENTION

1. Field of the Invention

The invention relates to a method and an apparatus of denitrating tobacco stem material.

2. Description of the Invention

In processing tobacco stem material it is desirable that unwanted soluble materials contained in the tobacco stem material, such as e.g. nitrate salts, are removed therefrom prior to the tobacco stem material being further processed into smokable products.

It is usually the case that water or steam is sprayed onto the tobacco stem material in several stages, and the tobacco stem material is buffer-stored between the individual stages of spray treatment. Thereafter it is shredded, and, where necessary, sauced and dried.

The drawback in this method is the lengthy duration of treatment of the tobacco stem material.

In German Patent 34 19 655 C2 a method of producing a tobacco product low in nitrates by the extraction of soluble constituents from a grade of tobacco is described in which the latter is first brought into contact by known means with a solvent so as to produce the slurry. After this the major part of the solvent together with the dissolved constituents is removed from the slurry to retain the tobacco saturated with the solvent, after which a few of the dissolved constituents are separated out from the solvent and at least part of the solvent is returned to produce a further tobacco solvent slurry. This method is carried out under atmospheric conditions.

SUMMARY OF THE INVENTION

The object of the present invention is to propose a method and an apparatus for swift and cost-effective denitration of tobacco stem material.

In a method of denitrating tobacco stem material in which the tobacco stem material is input into the interior of a housing, is brought into contact with a solvent and is output from the housing, this object is achieved by the interior of said housing being pressurized and said tobacco stem material guided by a feeder screw through a bath of said solvent and the gas phase in the housing. An apparatus according to the invention for denitrating tobacco stem material comprises an elongated, approximately cylindrical pressure-tight housing, a rotatable feeder screw arranged in said housing and pressure-tight locks or nozzles of said housing for inputting and/or outputting liquid and/or gaseous solvent as well as tobacco stem material, wherein the longitudinal axis of said housing is inclined at an angle ($\alpha$) of approx. 5° to 20°, particularly approx. 10°, to the horizontal so that in the bottom region of the housing a bath of solvent exists.

Expedient embodiments read from the features defined in the sub-claims.

Due to the method according to the invention the following effect is achievable: when tobacco stem material is introduced continuously intermingled into a solvent bath, the existing pressure being or having already been simultaneously elevated to a level above that of normal atmospheric pressure, a swift denitration of the tobacco stem material into the solvent takes place. This denitration amounts up to 80% and may occur within 1 to 6 minutes.

A further advantage of the method according to the invention is that a plurality of parameters may be set so that when the method is suitably parameterized the quantity of the nitrate depleted from the tobacco stem material can be determined relatively precisely.

In addition, it is of advantage in the method according to the invention that in this treatment the tobacco stem material is also moistened quickly, i.e. within 1 to 6 minutes, so that, depending on the conditions of the method selected, it immediately has the required cutting moisture content or the latter may be set in subsequent treatment without dust materializing and thus resulting in a considerable material gain.

This moistened tobacco stem material, e.g. of Burley tobacco, having a moisture content of roughly 70% by weight may be blended with dry material, e.g. tobacco stem material which may also originate from some other grade of tobacco, such as e.g. Virginia, so that when the blend ratio is suitably selected a final moisture content of the blend may be attained with which the total blend following a storage time of at least 15 hours has the desired final moisture content in a range of roughly 28% to 42% and can be cut. Accordingly, it is of advantage that the additional tobacco stem material, such as for example Virginia tobacco stem material, does not need moisturizing, as a result of which the costs of producing such a cuttable blend are reduced.

A further advantage is that under pressure and at correspondingly high temperatures moisturized tobacco stem material holds longer than tobacco stem material treated by the moisturizing method hitherto.

Expediently water is employed as the solvent, since this is relatively cheap and is also excellently suited for denitration.

It is particularly preferred to implement the method at an elevated temperature since as a result of this the efficiency of the method is further enhanced.

In a particularly preferred embodiment the method takes place with a continual flow of tobacco stem material and preferably also of solvent so that it can be linked into a continually operating process. Due to the fact that the solvent is continually replaced it can be avoided that an enrichment of the nitrate salts extracted from the tobacco stem material materializes in the solvent, which would ruin denitration of the tobacco stem material. This thus assures that the tobacco stem material passing through the solvent continually can be treated under consistent conditions so that later on tobacco stem material is not passed through a solvent in which a high concentration of nitrate salts extracted from tobacco stem material having passed through earlier exists, which would greatly diminish the desired depletion effect and thus result in deterioration of the efficiency of the method.

The ratio of the mass flow of dry tobacco stem material to the mass flow of solvent is most preferably 0.25.

Preferably the solvent exists in a liquid phase in the bath. The gaseous phase of the solvent serves to set an overpressure and thus an elevated temperature in the extractor as a result of which denitration is optimized and accelerated. It is particularly important thereby to ensure that the level of the solvent bath is maintained constant, since solvent is carried off by the moist tobacco stem material.

Thus, the denitration taking place in the housing may be done e.g. in two steps: the tobacco stem material present in the solvent bath passes through a first depletion procedure, attains—whilst being continually intermingled—the region of the housing where a further solvent feed takes place, especially in the form of a nozzle feed which affects a further, second depletion procedure by exchange of the surface solvent on the stem material by fresh solvent.

It is particularly preferred to continuously add gaseous solvent during the depletion process, preferably at elevated temperatures and overpressure so that the pressure existing in the liquid phase of the solvent as well as the temperature and thus the conditions in the housing can be precisely set.

Expediently the rotary speed of the feeder screw may be varied since as a result of this the dwell time of the tobacco stem material in the housing can be established which usually amounts to approx. 1 to 6 minutes. Likewise, the dwell time can be set via the geometry of the feeder screw such as e.g. by the lead, pitch or length thereof.

Likewise to advantage the mass flow of the tobacco stem material, introduced into the housing, may be set so that a precisely determined amount of stem material can be depleted.

In one variant of the method the solvent taken continually from the housing at one point is returned at a second point, it thereby passing through various stages in the method such as e.g. the addition of further solvent to condense the solvent taken from the housing, consisting of a mixture of the liquid phase and gaseous phase. Preferably, however, adding solvent is done with fresh solvent, not solvent containing nitrate.

Preferably the method is implemented at an absolute pressure of roughly 1.5 bar to approx. 3.0 bar, particularly at roughly 1.9 bar. Thus, during the method an overpressure of approx. 0.5 bar to 2.0 bar, preferably roughly 0.9 bar exists in the housing.

The apparatus for implementing the method comprises an elongated, approximately cylindrical housing including a feeder screw arranged therein and is configured pressure-tight. Furthermore provided are pressure-tight locks and/or nozzles to permit the continual feed and discharge of solvent and/or tobacco stem material. The longitudinal axis of the housing is inclined slanting to the horizontal, preferably at an angle of 5° to 20°, preferably 10°, since this inclined position achieves a better intermingling of the tobacco stem material passing through the housing preferrably in the longitudinal direction with the solvent in the bath which collects at the bottom end of the housing.

BRIEF DESCRIPTION OF THE DRAWINGS

The invention will now be explained in detail on the basis of a preferred embodiment with reference to the following drawings in which.

DESCRIPTION OF THE PREFERRED EMBODIMENTS

Figure 1:
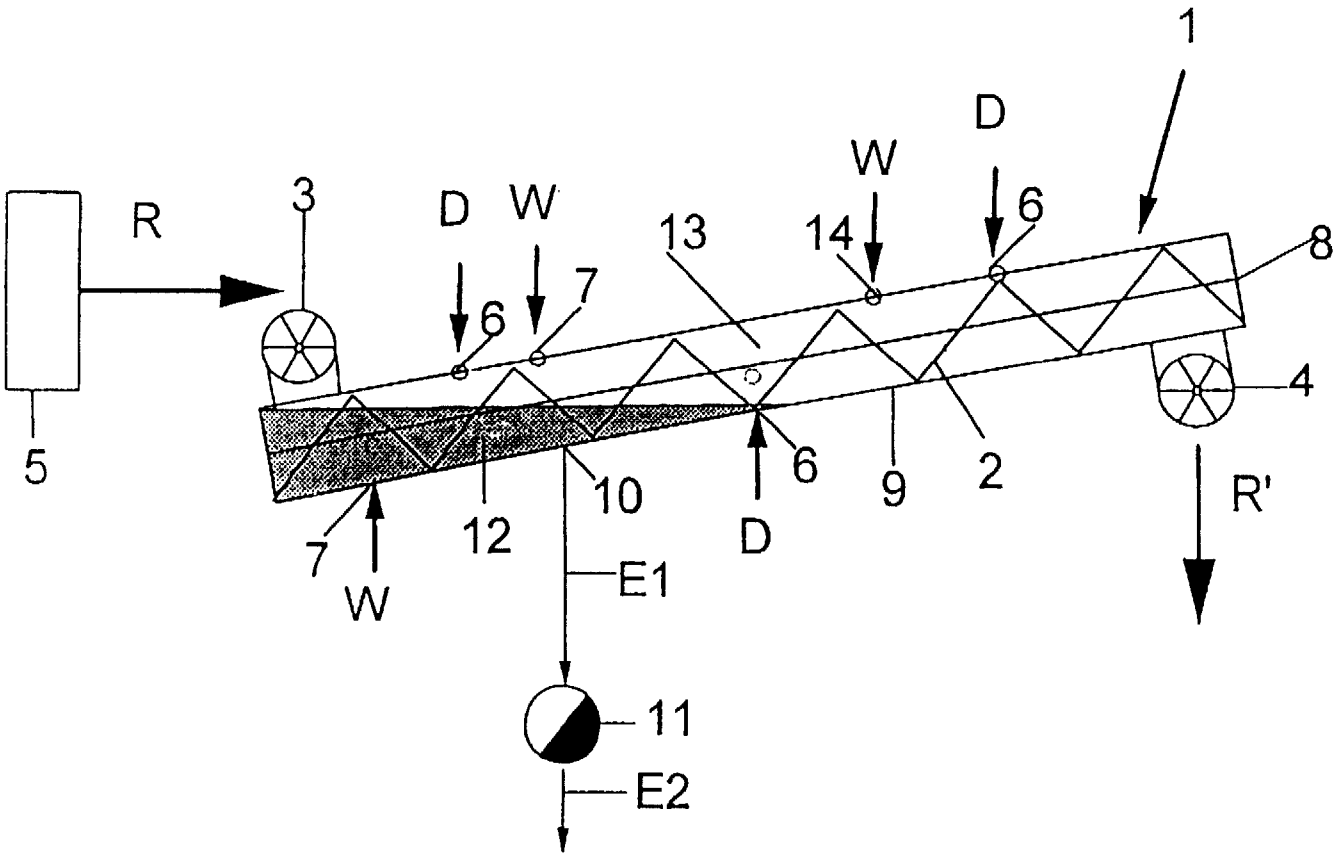
FIG. 1 is a flow chart of the materials flows involved in the method as well as a schematicized illustration of a pressure-conditioning screw.

The pressure conditioning screw signified generally by the reference numeral 1 illustrated in FIG. 1 comprises an elongated, cylindrical housing 9 configured pressure-tight which is bulkheaded off at both ends by means of pressure-tight locks 3, 4. In the housing an overpressure of roughly 0.9 bar exists. The longitudinal axis of the pressure conditioning screw 1 is inclined at an angle α of roughly 10° to the horizontal.

In the interior of the pressure conditioning screw 1 a feeder screw 2 is arranged centered which is rotatably mounted about its center line 8 which is simultaneously the center line of the pressure conditioning screw 1. The housing 9 comprises steam nozzles 6 through which the interior of the pressure conditioning screw 1 can be charged with steam. Distributed over the full length of the pressure conditioning screw 1 are water nozzles 7 through which water can be introduced into the interior of the pressure conditioning screw 1. At the bottom end of the pressure conditioning screw 1 a water bath 12 collects in operation which has a certain level regulated by the water feed and discharge. In the remaining interior space of the pressure conditioning screw 1 steam 13 exists above the water bath.

Stem material R of Burley tobacco rich in nitrates gains access from a volume metering unit 5 via the pressure-tight lock 3 of the pressure conditioning screw 1 to the interior of the housing 9. It is guided there by the feeder screw 2 with continual rotation of the latter in the direction of the upper end of the pressure conditioning screw 1. In this arrangement it first passes through the water bath 12 and then the interior region of the pressure conditioning screw 1 which is filled with steam 13. When the stem material R rich in nitrates first passes through the water bath 12 and then the interior region of the housing 9 filled with steam 13 it is moisturized, the nitrates contained in the stem material R are dissolved with the aid of the solvent water 12 from the stem material R and pass into the solvent. After having passed through the solvent bath 12 the stem material low in nitrates is rinsed with fresh solvent from the nozzle 14 to replace the surface solvent of the stem material. At the upper end of the pressure conditioning screw 1 the now moisturized stem material R' low in nitrates is brought out from the pressure conditioning screw 1 through the pressure-tight lock 4 so that the treated stem material R' low in nitrates can be made available with a moisture content of approx. 70% at this point for further treatment, particularly for possible blending with dry tobacco material, e.g. dry stem material.

In the region of the water bath 12 of the pressure conditioning screw 1 an outlet 10 is provided through which the two-phase blend of the solvents consisting of steam 13 and water 12 is brought out from the interior of the pressure conditioning screw 1 via a conduit E1. The two-phase blend transported in the conduit E1 gains access to a steam trap 11. The condensate is drained off from the steam trap 11 via a conduit E2.

The complete method is carried out at high temperatures in the range of approx. 100° to approx. 130° C., particularly at approx. 118° C., as a result of which the life of the tobacco stem material R, R' is improved.

The dwell time of the tobacco stem material R in the housing 9 and particularly in the water bath can be set or regulated, the thruput time of the tobacco stem material through the housing normally being in the range of one to six minutes. A precise setting of the dwell time is achievable in particular by regulating the rotary speed of the feeder screw 2.

Further substantial parameters of the method are the mass flow of the tobacco stem material R fed to the pressure conditioning screw 1 and the volume of the water bath provided, the fresh water feed on the one hand and, on the other, the replacement of the water containing the nitrates needing to be taken into account.

The ratio of mass flow of dry tobacco in kg to mass flow of water in kg should lie in the range of approx. 0.5 to approx. 0.031 and preferably at approx. 0.25.

It is also possible to implement the method in counterflow, i.e. the direction of the flow of tobacco stem material R, R' and that of the solvent may also be against each other so that e.g. a first flow in the method (solvent or tobacco stem material R') is guided from top to bottom counter to the second flow of the method (tobacco stem material R or solvent).

Figure 2:
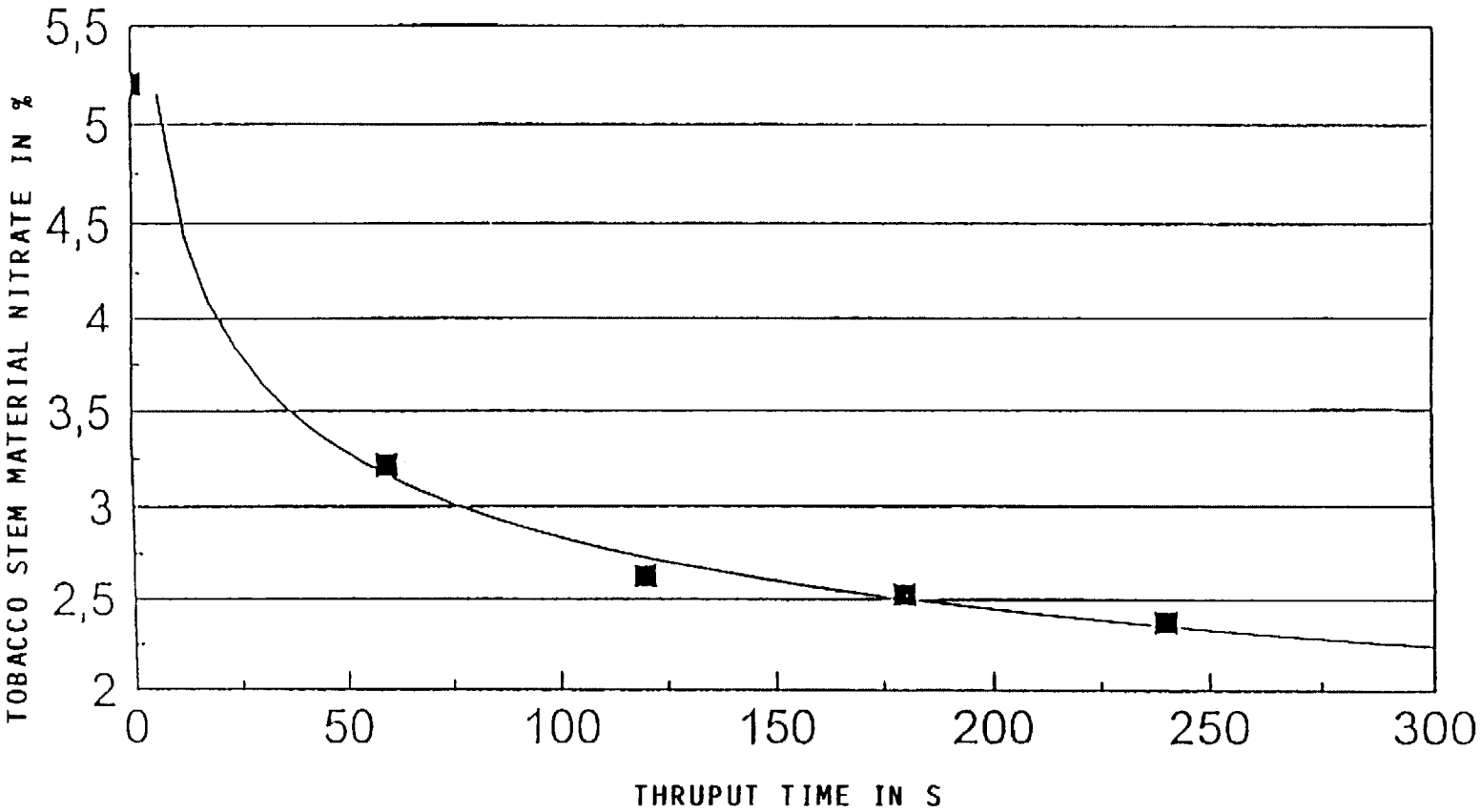
FIG. 2 is an example of how the nitrate content of the treated tobacco stem material depends on the thruput time through the apparatus according to the invention.

FIG. 2 shows how the nitrate content of the tobacco stem material R' depends on the thruput time of the tobacco stem material R' through the apparatus according to the invention. The input stem material R had a nitrate content there of approx. 5.25%. The absolute pressure in the pressure conditioning screw 1 was 1.9 bar for a temperature of 118° C. The mass flow of the dry tobacco stem material was set to 45 kg/h.

It will be appreciated that after a thruput time of 240 sec. already it was possible to reduce the nitrate content of the tobacco stem material R, R' by more than 50%, namely to approx. 2.4%. Further improvements are still possible but at the cost of significantly longer dwell times.

We claim:

1. A method of denitrating tobacco stem material in which a) the tobacco stem material is input into the interior of a housing, b) is guided by a feeder screw through a water bath and c) is output from the housing, in which d) the interior of said housing is pressurized, e) the tobacco stem material is guided by the feeder screw through steam downstream of the water bath in said housing, f) is subjected to water rinsing during the treatment with steam, and g) the passage time through the housing being from one to six minutes.

2. The method as set forth in claim 1, wherein in said housing a temperature of approx. 100° C. to 130° C. is maintained.

3. The method as set forth in claim 1, wherein Burley tobacco stem material is treated.

4. The method as set forth in claim 1, wherein a continual flow of tobacco stem material and/or water is employed.

5. The method as set forth in claim 1, wherein said water is continually exchanged.

6. The method as set forth in claim 1, wherein said water in said housing consists of a liquid phase and a gas phase.

7. The method as set forth in claim 6, wherein said gas phase of said water is supplied to said housing.

8. The method as set forth in claim 1, wherein the dwell time of said tobacco stem material in said bath of water is set, particularly by adjusting the feed rate.

9. The method as set forth in claim 1, wherein the mass flow of said tobacco stem material is set so that the ratio of mass flow of dry tobacco in kg to the mass flow of water in kg lies in the range of approx. 0.5 to 0.031.

10. The method as set forth in claim 1, wherein the tobacco stem material is subjected to a further treatment, particularly a solvent shower.

11. The method as set forth in claim 1, wherein in said housing an absolute pressure of approx. 1.5 bar to 3.0 bar, is maintained.

12. The method as set forth in claim 1, wherein in said housing a temperature of approx. 118° C. is maintained.

13. The method as set forth in claim 1, wherein in said housing an absolute pressure of approx. 1.9 bar is maintained.

14. An apparatus for denitrating tobacco stem material, comprising a) an elongated, approximately cylindrical, pressure-tight housing, b) a rotatable feeder screw arranged in said housing, c) pressure-tight locks and means for supplying and removing liquid and gaseous solvent as well as tobacco stem material, wherein d) the longitudinal axis of said housing is inclined at an angle ($\alpha$) of approx. 5° to 20° to the horizontal so that in the bottom region of the housing a water bath exists, e) the housing comprises a plurality of nozzles for supplying the liquid and gaseous solvent and f) a nozzle for rinsing the tobacco stem material having passed through the water bath.

15. The apparatus of claim 14, wherein the longitudinal axis of said housing is inclined at an angle ($\alpha$) of approx. 10° to the horizontal.

* * * * *